US006957678B2

(12) United States Patent
Scholl et al.

(10) Patent No.: US 6,957,678 B2
(45) Date of Patent: Oct. 25, 2005

(54) DEVICE FOR TENSIONING AND CLOSING HOOP BANDS

(75) Inventors: Detlef Scholl, Piesport (DE); Christian Spohr, Bad Naubeim (DE); Peter Nober, Rommersheim (DE)

(73) Assignee: Cyklop GmbH (DE)

( * ) Notice: Subject to any disclaimer, the term of this patent is extended or adjusted under 35 U.S.C. 154(b) by 310 days.

(21) Appl. No.: 10/296,866

(22) PCT Filed: Apr. 21, 2001

(86) PCT No.: PCT/EP01/04532

§ 371 (c)(1),
(2), (4) Date: Nov. 25, 2002

(87) PCT Pub. No.: WO01/92112

PCT Pub. Date: Dec. 6, 2001

(65) Prior Publication Data

US 2003/0121611 A1 Jul. 3, 2003

(30) Foreign Application Priority Data

May 26, 2000 (DE) ..... 100 26 197

(51) Int. Cl.[7] ..... B65B 13/24; B65B 13/22; B65B 67/08

(52) U.S. Cl. ..... 156/494; 156/502; 156/580; 53/582; 53/589; 100/29; 100/33 PB; 24/69 TM

(58) Field of Search ..... 156/494, 502, 156/580, 581, 583.1; 53/582, 592, 589, 590; 100/29, 33 R, 33 PB

(56) References Cited

U.S. PATENT DOCUMENTS

| | | | | | |
|---|---|---|---|---|---|
| 2,982,069 | A | * | 5/1961 | England | 53/592 |
| 3,944,460 | A | * | 3/1976 | Karr | 156/494 |
| 4,488,926 | A | | 12/1984 | Rauch et al. | |
| 5,117,615 | A | * | 6/1992 | Kung et al. | 53/592 |
| 5,632,851 | A | * | 5/1997 | Young | 156/494 |
| 6,003,578 | A | * | 12/1999 | Chang | 156/494 |
| 6,412,257 | B1 | * | 7/2002 | Liu et al. | 53/592 |
| 6,564,701 | B1 | * | 5/2003 | Liu et al. | 100/29 |
| 6,578,337 | B2 | * | 6/2003 | Scholl et al. | 100/33 PB |
| 2003/0056337 | A1 | * | 3/2003 | Scholl et al. | 24/69 TM |
| 2003/0131570 | A1 | * | 7/2003 | Scholl et al. | 53/582 |

FOREIGN PATENT DOCUMENTS

| | | |
|---|---|---|
| GB | 1 206 458 | 9/1970 |
| GB | 2 082 138 A | 3/1982 |

* cited by examiner

*Primary Examiner*—Sue A. Purvis
(74) *Attorney, Agent, or Firm*—Fay, Sharpe, Fagan, Minnich & McKee, LLP

(57) ABSTRACT

The device according to the invention for tensioning and sealing of strapping bands has a band abutment (24) for the inner band edges (27) of the band ends (20, 21) to be welded together, which is provided with a band width adjustment device (28) according to the invention, with the help of which the band abutment adjusts the band abutment transversely to the longitudinal direction of the strapping band in the housing and that the device can be adjusted to strapping having with different widths without any reconstruction measures (see FIG. 3).

15 Claims, 4 Drawing Sheets

DEVICE FOR TENSIONING AND CLOSING HOOP BANDS

Figure 1:
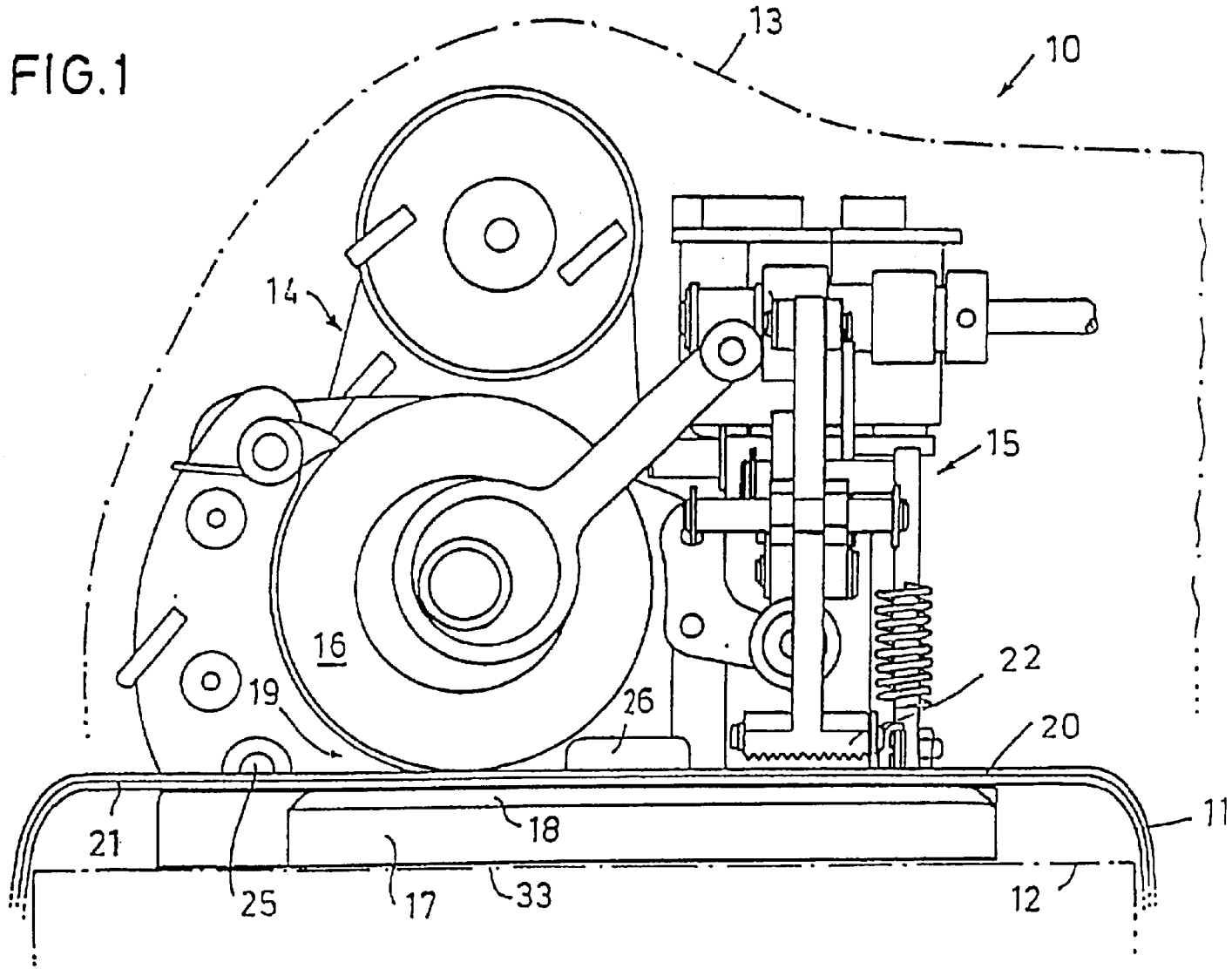

This invention relates to a device for tensioning and closing strapping bands for packages or the like, with a housing, a band channel open at one side at a longitudinal side of the housing in a longitudinal direction, a welding device effective in the band channel which connects the band ends of the strapping band to one another, and with a band abutment arranged at the outer or inner longitudinal side of the band channel guiding the band ends laterally.

Devices of this type serve for tensioning plastic bands which are placed around packages or the like and to seal them into a strapping, and to thereby prevent the falling apart of the packages. The thermoplastic plastic band is generally placed around the package by hand or with a strapping tool, and the band ends of the strapping band are then inserted into the band channel from the open longitudinal outer side of the housing in such a manner that the band ends are lying clean on top of one another. The lower band end will be held by a tensioning plate or the like for tensioning the band ends to one another, while the upper band end is drawn over the lower band end by means of a driven tensioning wheel until the desired tension is achieved. Subsequently, the welding device is actuated, which rubs the upper band end over the lower band end with a large velocity by means of a friction jaw which can be moved transversely to the longitudinal direction of the band, whereby the plastic material is heated and the two band ends are thereby welded. During the tensioning of the band ends against one another, the band abutment provides that the band ends are superposed exactly with regards to their edge and that a clean and tight strapping is produced in this manner.

It is desirable to be able to process strapping bands having different band widths with the same device. But so that the band ends of the strapping bands with different widths always take up the correct position relative to the welding device and are guided cleanly and exactly with their edges, it is necessary with the known devices to exchange the band abutment during the processing of a new smaller or wider band, so as to adapt the width of the band channel to the new band width. For this, several components of the device have to be regularly removed and exchange parts have to be installed again, which is not only very time-consuming, but which also requires a lot of experience from the user, as a faulty installation of the exchange parts of the band abutment can lead to damage at the apparatus and/or to bad weld locations at the strapping, which then do not keep the packages securely together. The known devices require furthermore a disadvantageous supply inventory of exchange parts of the band abutment for the different band widths and it can easily result that the parts are lost and are not available when they are needed.

It is the object of the invention to improve a device of the above-mentioned type so that bands with different widths can be processed in a particularly easy manner without elaborate reconstruction procedures.

This object is solved by means of the invention in that the band abutment can be adjusted transversely to the longitudinal direction of the strapping band by means of a band width adjustment device.

According to the invention, the device is provided with a band width adjustment device with the help of which the band abutment can be adjusted in the housing and can be adjusted to different band widths in a very simple manner without the exchange of any components. The arrangement is conveniently made in such a way that the band width adjustment device comprises an adjustment mechanism which can be actuated from the outer side of the housing, which essentially can consist of a rotatable eccentric drive which is coupled to the band abutment and which can be locked in different rotary positions. A rotary movement exerted from the outside of the housing to the eccentric drive is then translated thereby into a longitudinal movement, with which the band abutment is displaced transversely in the housing.

The band abutment is preferably coupled to the adjustment mechanism by means of an adjustment slide which is adjustable in the housing transverse to the longitudinal direction of the strapping band. The eccentric drive can essentially consist of an adjustment disc which is mounted rotatably, which is provided with an actuation pin arranged eccentrically to its rotation axis, which engages a longitudinal hole arranged at the adjustment slide. Such a construction is particularly simple and reliable and allows an exact positioning of the band abutment in the respective desired position. The adjustment disc is preferably formed as an engagement disc with several engagement notches distributed over its circumference into which engages a spring-loaded thrust piece with its sealing end in a engaging manner. The thrust piece which engages the engagement notches effects that the band abutment is always arrested exactly in the same positions which are given for different available band widths. If for example bands having widths of 10, 13, 16 and 19 mm are to be welded with the device, the adjustment disc has four engagement notches at its circumference, whereby the band abutment is displaced at the longitudinal side of the band channel by respectively 3 mm by moving the adjustment disc from one engagement position to the next.

A particularly preferred arrangement results when the actuation angle of the adjustment disc is about 180° and is limited by the longitudinal hole at the adjustment slide. It is thereby impossible to displace the band abutment further than a given minimum and maximum width in the band channel, as the adjustment disc can only be rotated between these two extreme values. The adjustment disc is preferably accessible from the outside of the bottom of the housing for its actuation, whereby it can conveniently be rotated with the help of a suitable tool, for example a screw driver or an inner key. The adjustment slide is conveniently received in a guide groove in a transversely displaceable manner with a guide part, which groove is arranged in the housing, preferably at the bottom of the housing.

An especially preferred arrangement of the invention consists in that the band abutment comprises a first band abutment element and a second band abutment element, whereby the first abutment element is rigidly connected to the adjustment slide relative thereto, while the second band abutment element is arranged close to the welding device and is mounted to the adjustment slide in a displaceable manner relative thereto. During the insertion and tensioning of the strapping band the two band abutment elements of the band abutment guide the edges of the band ends together. Before the welding device is subsequently activated, the second abutment element can laterally be drawn away from the edges of the band ends to be welded, so that it does not constitute an obstacle when the welding device chafes one band end over the other one and produces the heat that is necessary for welding. The first band abutment element which has a larger distance to the welding location, keeps its position during the welding and thereby ensures the exact edge position of the band ends on top of one another. The fixing of the band ends which are tensioned against one another in their exact edge position takes place in the region of the first band abutment element by means of the tensioning wheel and the tensioning plate co-operating therewith, which tension the band ends between each other.

The second band abutment element which is arranged near the welding device is conveniently received in a transversely displaceable manner in a guide groove arranged at the housing, preferably at the bottom of the housing. The guide part of the adjustment slide and the second band abutment element can thereby be received in the same guide groove.

It is particularly advantageous if the second band abutment element is coupled to a withdrawal mechanism which is connected to the welding device and which can be actuated thereby, so that it is automatically withdrawn from the band edges as soon as the welding device is actuated. The withdrawal mechanism can essentially consist of an actuation spring and of an adjustment lever loaded by an actuation element of the welding device, whereby the adjustment lever is preferably pivotally mounted at a holding flange which is arranged at the adjustment slide and engages the actuation spring on the one hand at the second band abutment element and on the other hand at the adjustment slide.

If the adjustment lever comprises an essentially straight actuation surface for the actuation element, which is approximately parallel to the movement direction of the adjustment slide and comprises a length which corresponds at least to the adjustment path of the band width adjustment device, it is ensured in a particularly simple manner that, during the displacement of the position of the band abutment to another band width, both band abutment elements are displaced with an equal distance in the band channel, as the position of the adjustment lever relative to the second band abutment element does not change, as long as the actuation element acts on the actuation surface.

Figure 2:
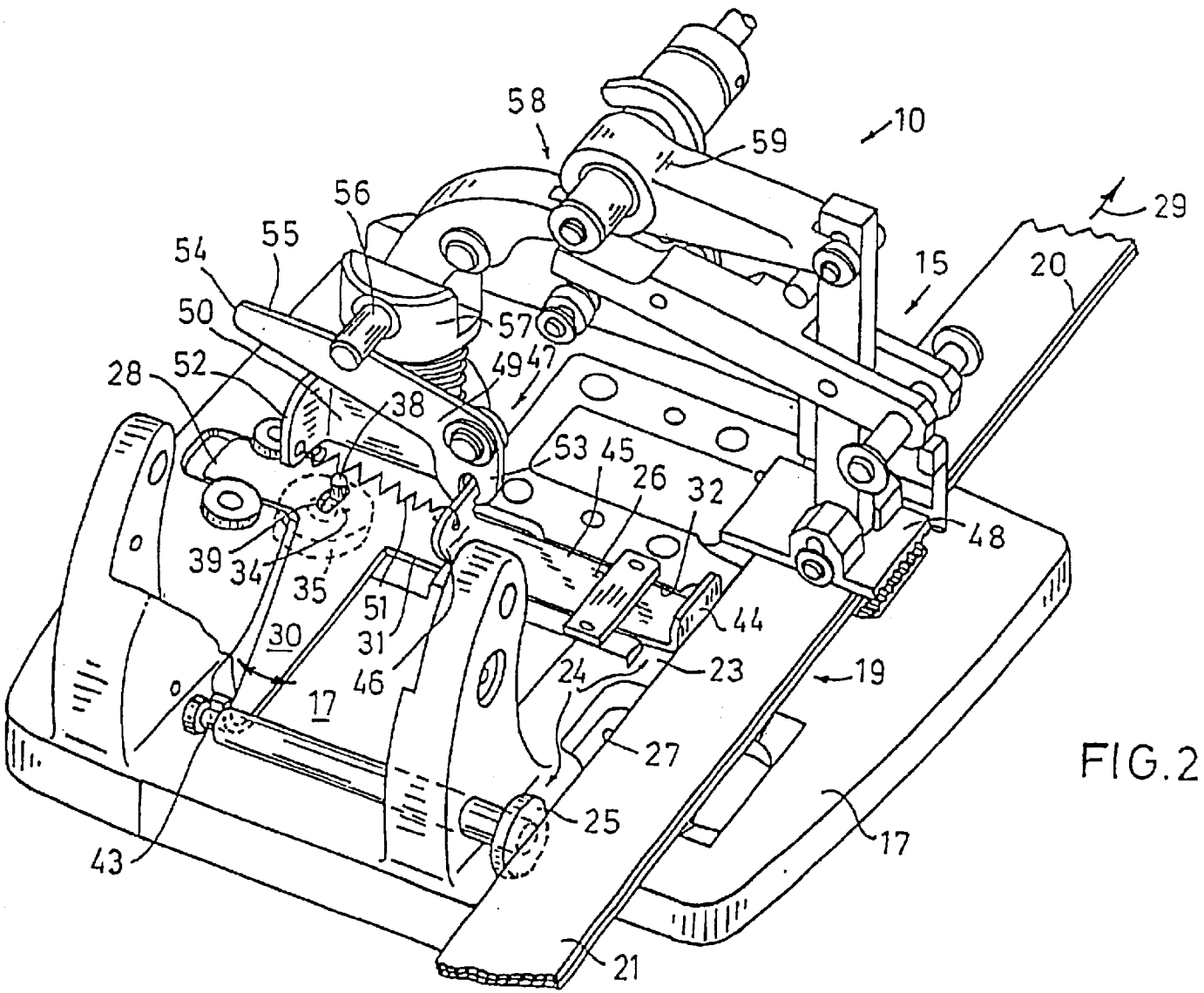
Figure 3:
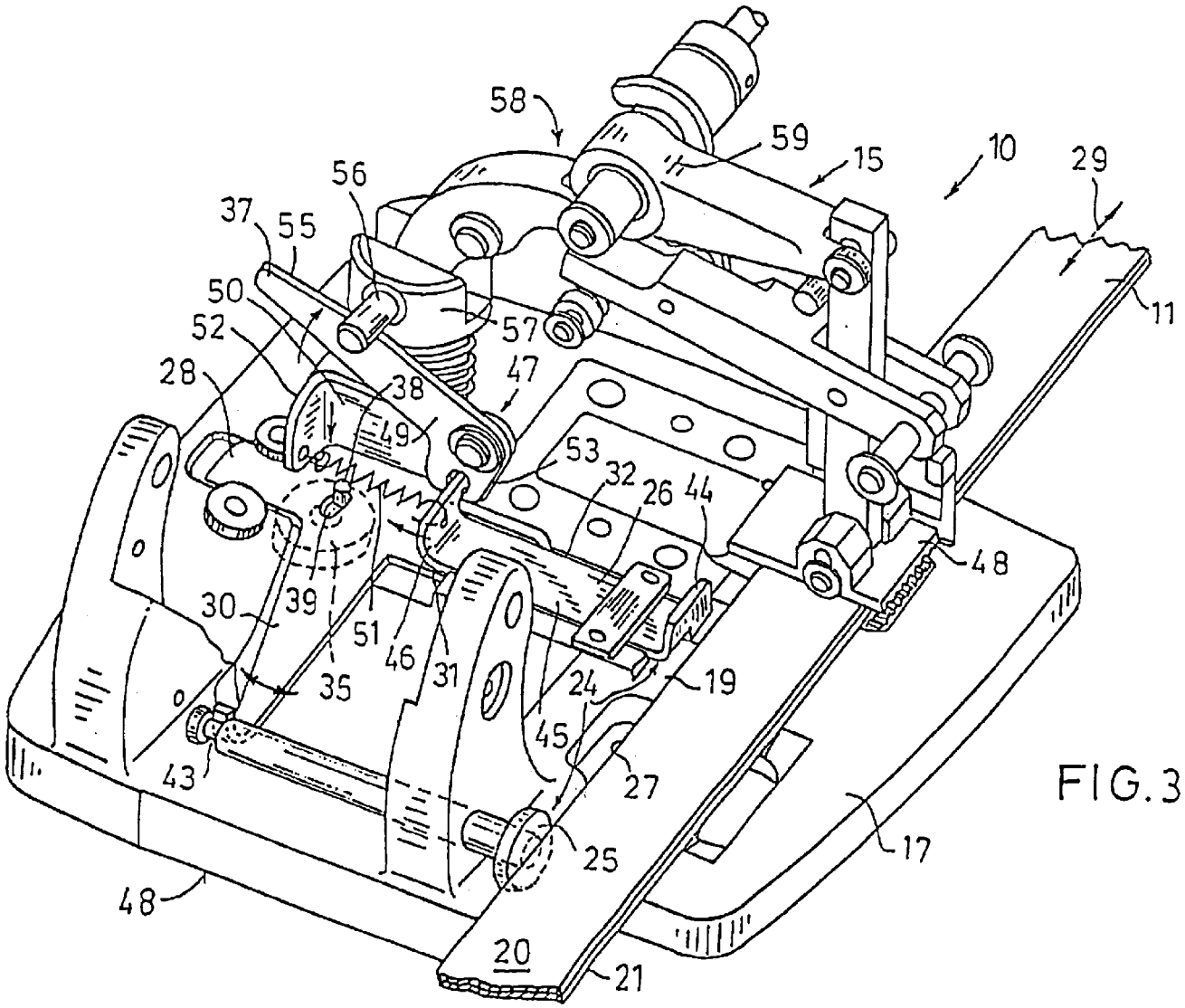
Figure 4:
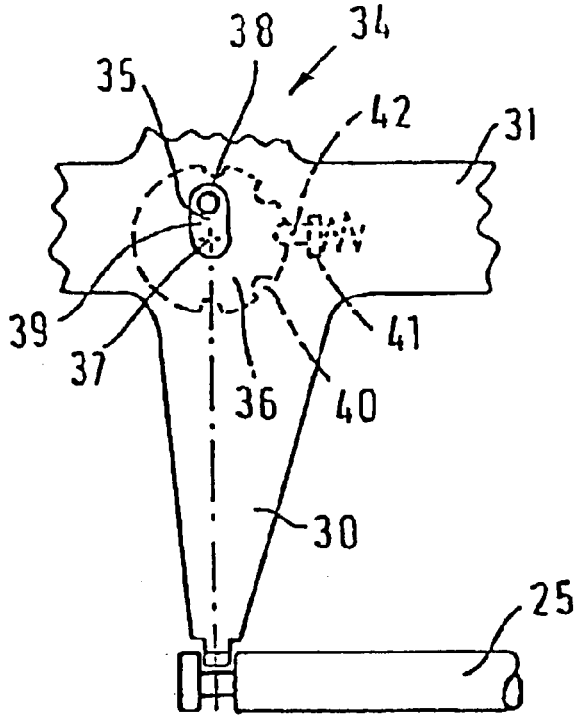
Figure 5:
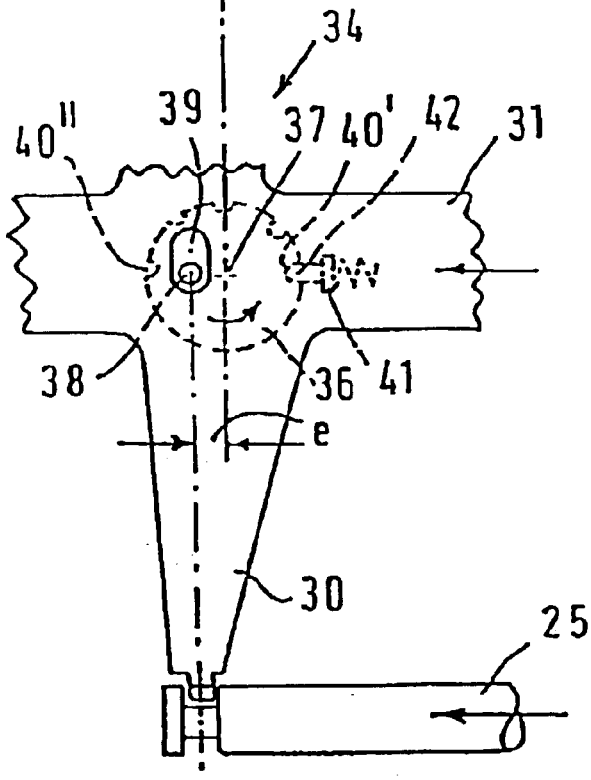

Further characteristics and advantages of the invention result from the following description and the drawing, wherein a preferred embodiment of the invention is explained in more detail with an example. It shows:

FIG. 1 a side view of a device according to the invention, whereby the housing of the device is only shown in dashed lines for to a clearer depiction;

FIG. 2 a part of the device according to the invention according to FIG. 1 in a perspective representation with a band abutment abutting the edges of the band ends;

FIG. 3 the object of FIG. 2 after the actuation of the welding device with a band abutment withdrawn from the band edges;

FIG. 4 a detail of the band width adjustment device in the region of its adjustment mechanism in a first position; and FIG. 5 the object of FIG. 4 in a second position.

The device designated as 10 in its entirety serves for tensioning and sealing a plastic strapping band 11 which is placed around a package, which is shown in FIG. 1 at 12 with dashed lines.

The device 10 comprises a tensioning unit 14 in the inside of its housing 13 and a welding device 15 which is arranged behind it in the tensioning direction in FIG. 1 on the right hand from the tensioning unit. The tensioning unit consists in a known manner essentially of a driven tensioning wheel 16 and a tensioning plate 18 which is formed by the bottom 17 the housing, between which is formed a band channel 19 at one longitudinal outer side of the housing 13, which is open on one side, into which the two band ends 20, 21 of the strapping band 11 are inserted from the longitudinal outer side of the housing in such a manner that they engage in the front housing part in the region of the tensioning unit between the tensioning wheel 16 and the tensioning plate 18, and in the rear housing part in the region of the welding device between a friction plate of the welding device and the bottom 17 of the housing.

As can best be seen from FIGS. 2 and 3, the band channel 19 is limited by a band abutment 24 at its inner longitudinal side 23 close to the welding device 15, which abutment comprises a first forward band abutment element 25 in the tensioning direction in front of the tensioning unit 14 and a second band abutment element 26 which is arranged close to the welding device 15. The two superposed band ends 20, 21, abut the band abutment elements 25, 26 with their band edges 27 arranged in the band channel, so that they lie on top of one another.

For a use of the same device during the processing of strapping bands having different band width, the band abutment 24 is provided with a band width adjustment device 28, with the help of which the band abutment 24 can be displaced transversely to the longitudinal direction 29 of the strapping band. The band width adjustment device 28 is provided with an adjustment slide 30 which is mounted on the bottom 17 of the housing transversely to the longitudinal direction 29 of the strapping band 11, which is received in a guide groove 32 in the bottom of the housing 17 with a guide part 31, and to which the band abutment elements 25, 26 are coupled.

For adjusting the band abutment 24, the band width adjustment device 28 is provided with an adjustment mechanism which can be accessed from the lower side 33 of the bottom 17 of the housing, which essentially consists of a rotatable eccentric drive 35 which can be locked in different rotary positions. This comprises a displacement disc 36 which is rotatably mounted in the bottom 17 of the housing with an actuation pin 38 which is arranged eccentrically to its rotational axis 37, which comprises a longitudinal hole 39 which is provided at the adjustment slide 30. The displacement disc can be can be rotated with an inner key from the lower side 33 of the bottom of the housing, whereby the adjustment slide 30 and therewith the band abutment elements 25, 26 of the band abutment 24 are adjusted transversely to the longitudinal direction 29 of the strapping band.

The adjustment mechanism is shown in detail in FIGS. 4 and 5. As can easily be seen there, the displacement disc 36 is executed as a engagement disc and is provided with five engagement notches 40 distributed over half of its circumference, into which a spring-loaded thrust piece 41, which is received in the bottom 17 of the housing, can engage with its front locking end 42. With the position of the displacement disc 36 shown in FIG. 4, the thrust piece engages the centre one of the five possible engagement notches, whereby the longitudinal hole 39 in the adjustment slide 30 with the rotational axis of the adjustment disc 37 aligns in this position. In the position shown in FIG. 5, the thrust piece engages the engagement notch 40' for the largest band width provided, in which the band abutment elements 25, 26 are adjusted inwardly with an amount e and are in the furthest inner position in the band channel. When the thrust piece engages this or the opposite engagement notch 40", the actuation pin 38 abuts one end of the longitudinal hole 39, the lower end in the figure, so that the displacement disc can only be rotated to and fro by an amount of 180°.

As can be seen from the drawings, the first, front band abutment element 25 is coupled at 43 rigidly to the adjustment slide 30, and does not change its relative position to the adjustment slide. Whereas the second band abutment element 26, arranged near the welding device, is mounted in a displaceable manner relative to the adjustment slide 30, and can thus be drawn away from the band edges 27 during the moment when the welding device is actuated for connecting the band ends 20, 21.

For this, the second band abutment element 26 essentially consists of a U-shaped component, the front leg 44 of which forms an abutment surface for the band edges and the bridge 45 of which is received in a displaceable manner in the same guide groove 32 as the guide part 31 in the bottom 17 of the housing transversely to the longitudinal direction 29 of the strapping band.

A withdrawal mechanism 47 the rear leg 46 of the band abutment element 26, engages, which mechanism withdraws the second band abutment element 26 automatically from the advanced position shown in FIG. 2 into the withdrawn position shown in FIG. 3, when the friction plate 48 of the welding device 15 is lowered from the raised position shown in FIG. 2 into the effective position according to FIG. 3, in which it rigidly bears on the upper band end 20.

The withdrawal mechanism 47 comprises an adjustment lever 49, which is pivotally mounted at a holding flange 50 arranged at the adjustment lever 30, as well as a withdrawal spring 51, which engages the back leg 46 on the one hand and a connection plate 52 at the adjustment slide on the other hand. The adjustment lever 49 is provided with a fork head 53 overlapping the leg 46 of the band abutment element 26 at its shorter lever end, and with an actuation surface 55 at its longer leg 54, which runs parallel to the guide groove 32 in the position of the band abutment element 26 shown in FIG. 2 and which is held lowered in this position against the action of the withdrawal spring 51 by an actuation cam 56, which is situated at the main pressure spring 57 for the friction plate 48 of the welding device 15 and which is coupled to the friction plate 48 by means of a lever gear 58.

While the friction plate 48 of the welding device 15 is in its ineffective, raised position, in which the band ends 20, 21 can be inserted into the band channel 19 on top of one another, the actuation cam 56 presses the longer leg 53 of the adjustment lever 49 down by means of its actuation surface 55 and thereby the band abutment element 26 against the action of the withdrawal spring 51 inwardly into the band channel in the position shown in FIG. 2, in which the band edges can abut the abutment surface of the front leg 44, when the band ends are inserted into the band channel. If an actuation mechanism (not shown) for the welding device is now activated and the main pressure spring 57 is actuated in a known manner, so as to lower the friction plate 48 onto the upper band end 20, the actuation cam 56 moves upwards, so that it does not lock the longer leg of the adjustment lever 49 any longer in the approximate horizontal position which leads thereto that the withdrawal spring 51 withdraws the second band abutment element 26 in the guide groove 32 into the position shown in FIG. 3. It can be seen that the front leg 44 has then a sufficient distance from the band edges 27 of the band ends, so that the upper band end 20 can be moved to and fro from the friction plate 48 with the help of the respective eccentric drive 59 in an unimpeded manner over the lower band end transversely to the longitudinal direction 29 of the band, without abutting the band abutment element 26. When the friction plate 48 is raised again after the welding of the band ends and the main pressure spring 57 is compressed again, the actuation cam 56 presses the adjustment lever 48 down again, so that the band abutment element 26 is also displaced against the action of the withdrawal spring 51 in the guide groove 32 inwardly into the position shown in FIG. 2, in which the leg 44 abuts the band edges 27.

It can be seen that, during the adjustment of the band width with the help of the band width adjustment device 28, the relative position of the second band abutment element 24 to the adjustment slide 44 does not change as long as the actuation cam 39 holds the adjustment lever 33 in its downwardly pressed position, as the actuation surface 38 runs parallel to the guide groove 28 in this position. That is, the second band abutment element 26 is displaced by the same amount in the band channel during the adjustment of the band abutment 24 as the first front band abutment element 25 which is rigidly coupled to the adjustment plate, when the device shall be used for a strapping band having a different width.

The invention is not limited to the example of the embodiment shown and described, but a large number of changes and additions are possible without leaving the scope of the invention. It is for example conceivable to provide an adjustment element for the band width adjustment device which is translationally adjustable in the housing, or also an adjustment spindle which can be rotated from the outside, which cooperates with a spindle nut at the band abutment. With simple embodiments of the invention, one can forego the second abutment element which can be withdrawn during the welding. The second band abutment element 26 does not have to be arranged between the tensioning unit 14 and the welding device 15, as shown in the drawing, but it is also possible to arrange this second band abutment element 26 in the longitudinal direction 29 behind the welding device 15, that is at the backward end of the device.

What is claimed is:

1. A device for tensioning and closing strapping bands for packages or the like, with a housing, a band channel open at one side at a longitudinal side of the housing in a longitudinal direction, a welding device (15) effective in the band channel which connects the band ends of the strapping band to one another, and with a band abutment arranged at the outer or inner longitudinal side of the band channel guiding the band ends laterally, wherein the band abutment (24) can be adjusted in a transverse manner to the longitudinal direction (29) of the strapping band (11), and an adjustment mechanism (34) comprising a rotatable eccentric drive (35) coupled to the band abutment and is automatically locked in different rotary positions.

2. The device according to claim 1, wherein said adjustment mechanism (34) can be actuated from an outer side of the housing.

3. The device according to claim 1, wherein the band abutment (24) is coupled to the adjustment mechanism (34) by means of an adjustment slide (30) in the housing (13) which can be adjusted transversely to the longitudinal direction (29) of the strapping band (11).

4. The device according to claim 3, wherein the eccentric drive (35) comprises a rotatably mounted adjustment disc (36) provided with an actuation pin (38) arranged in an eccentric manner to its rotational axis (37), said pin engages a longitudinal hole (39) arranged at the adjustment slide (30).

5. The device according to claim 4, wherein the adjustment disc (36) is formed as an engagement disc having several engagement notches (40) distributed over its circumference, into which a spring-loaded thrust piece (41) engages with its locking end (42) in an engaging manner.

6. The device according to claim 4, wherein the actuation angle of the adjustment disc (36) is about 180° and is limited by the longitudinal hole (39) at the adjustment slide (30).

7. The device according to claim 4, wherein the adjustment disc (36) is accessed from outside (33) of a bottom (17) of the housing for actuation of said adjustment disc.

8. The device according to claim 7, wherein the adjustment slide (30) is received in a guide groove (32) with a guide part (31) in a transversely displaceable manner which is arranged at the housing (13), preferably in the bottom (17) of the housing.

9. The device according to claim 3, wherein the band abutment (24) comprises a first band abutment element (25) and a second band abutment element (26), whereby the first band abutment element (25) is rigidly connected to the adjustment slide (30) relative thereto, while the second band abutment element (26) is arranged near the welding device (15) and is mounted to the adjustment slide (30) in a relative slidable manner.

10. The device according to claim 9, wherein the second band abutment element (26) is received in a transversely displaceable manner in a guide groove (32) which is arranged at the bottom (17) of the housing.

11. The device according to claim 10, wherein a guide part (31) and the second band abutment element (26) are each received in the guide groove (32).

12. The device according to claim 9, wherein the second band abutment element (26) is coupled to a withdrawal mechanism (47) which is connected to the welding device (15) and actuated thereby.

13. The device according to claim 12, the withdrawal mechanism (47) comprises an actuation spring (51) and an adjustment lever (49) loaded by an actuation element (56) of the welding device (15).

14. The device according to claim 13, wherein the adjustment lever (49) is mounted in a pivotable manner at a holding flange (50) arranged at an adjustment slide (30) and that the actuation spring (51) engages one of the second band abutment element (26) and the adjustment slide (30).

15. The device according to claim 14, wherein the adjustment lever (49) comprises an essentially straight actuation surface for the actuation element (56), which runs in an approximately parallel manner in the abutment position of the second band abutment element (26) to the movement direction of the adjustable slide (30) and comprises a length which at least corresponds to the adjustment path of the band width adjustment device (28).

* * * * *